US010474098B2

(12) United States Patent
Nakao

(10) Patent No.: US 10,474,098 B2
(45) Date of Patent: Nov. 12, 2019

(54) POWDER PROCESSING APPARATUS

(71) Applicant: FUJI XEROX CO., LTD., Tokyo (JP)

(72) Inventor: Masayoshi Nakao, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/051,503

(22) Filed: Aug. 1, 2018

(65) Prior Publication Data

US 2019/0310572 A1 Oct. 10, 2019

(30) Foreign Application Priority Data

Apr. 4, 2018 (JP) ..... 2018-072522

(51) Int. Cl.

| | |
|---|---|
| ***G03G 15/20*** | (2006.01) |
| ***G03G 21/20*** | (2006.01) |
| ***G03G 15/08*** | (2006.01) |
| ***G03G 15/16*** | (2006.01) |

(52) U.S. Cl.

CPC ..... *G03G 21/206* (2013.01); *G03G 15/08* (2013.01); *G03G 15/16* (2013.01); *G03G 15/2003* (2013.01)

(58) Field of Classification Search

CPC ..... G03G 21/20; G03G 21/203; G03G 21/206
See application file for complete search history.

(56) References Cited

U.S. PATENT DOCUMENTS

| | | | | |
|---|---|---|---|---|
| 7,424,241 | B2 | 9/2008 | Shirakata | |
| 2011/0211859 | A1* | 9/2011 | Shimoyama | G03G 15/2064 399/93 |
| 2011/0211860 | A1* | 9/2011 | Shimoyama | G03G 15/2064 399/93 |
| 2015/0268600 | A1* | 9/2015 | Umeno | G03G 15/2017 399/67 |
| 2016/0004218 | A1* | 1/2016 | Umemoto | G03G 21/206 399/92 |
| 2016/0077488 | A1* | 3/2016 | Umemoto | G03G 21/206 399/93 |
| 2016/0286669 | A1* | 9/2016 | Narahashi | B01D 46/0002 |
| 2018/0239298 | A1* | 8/2018 | Yabuki | G03G 21/10 |

FOREIGN PATENT DOCUMENTS

| | | |
|---|---|---|
| JP | 2006119469 | 5/2006 |
| JP | 2017125975 | 7/2017 |
| JP | 2017125976 | 7/2017 |

* cited by examiner

*Primary Examiner* — Carla J Therrien
(74) *Attorney, Agent, or Firm* — JCIPRNET

(57) ABSTRACT

A powder processing apparatus includes: a fixing unit that is provided in an apparatus housing and heats powder containing ultrafine particles to fix the powder on a processed medium; an exhaust unit including an exhaust path through which air near the fixing unit can be exhausted, a capturing part capable of capturing the ultrafine particles, and an airflow generating part that generates exhaust airflow, the exhaust unit exhausting the air near the fixing unit to the outside of the apparatus housing through the exhaust path; and an intake unit including an intake path through which air outside the apparatus housing can be taken in, a capturing part capable of capturing the ultrafine particles, and an airflow generating part that generates intake airflow, the intake unit taking the air outside the apparatus housing into the apparatus housing through the intake path. An intake port is provided below an exhaust port.

12 Claims, 8 Drawing Sheets

| PROPERTY PARAMETER | EXHAUST PROPERTY | INTAKE PROPERTY |
|---|---|---|
| AIR QUANTITY | Q1 | Q2 (> Q1) |
| OPENING AREA | A1 | A2 (> A1) |
| CAPTURING CAPACITY | F1 | F2 (> F1) |
| ⋮ | ⋮ | ⋮ |

POWDER PROCESSING APPARATUS

CROSS-REFERENCE TO RELATED APPLICATIONS

This application is based on and claims priority under 35 USC 119 from Japanese Patent Application No. 2018-072522 filed Apr. 4, 2018.

BACKGROUND

Technical Field

The present invention relates to powder processing apparatuses.

SUMMARY

According to an aspect of the invention, there is provided a powder processing apparatus including: a fixing unit that is provided in an apparatus housing and heats powder containing ultrafine particles to fix the powder on a processed medium; an exhaust unit including an exhaust path through which air in the vicinity of the fixing unit can be exhausted, a first capturing part capable of capturing the ultrafine particles, and a first airflow generating part that generates exhaust airflow, the first capturing part and the first airflow generating part being provided in part of the exhaust path, the exhaust unit exhausting the air in the vicinity of the fixing unit to the outside of the apparatus housing through the exhaust path; and an intake unit including an intake path through which air outside the apparatus housing can be taken in, a second capturing part capable of capturing the ultrafine particles, and a second airflow generating part that generates intake airflow, the second capturing part and the second airflow generating part being provided in part of the intake path, the intake unit taking the air outside the apparatus housing into the apparatus housing through the intake path. An intake port of the intake unit is provided below an exhaust port of the exhaust unit in a gravity direction.

BRIEF DESCRIPTION OF THE DRAWINGS

Exemplary embodiments of the present invention will be described in detail based on the following figures, wherein.

DETAILED DESCRIPTION

Outline of Exemplary Embodiment

Figure 1B:
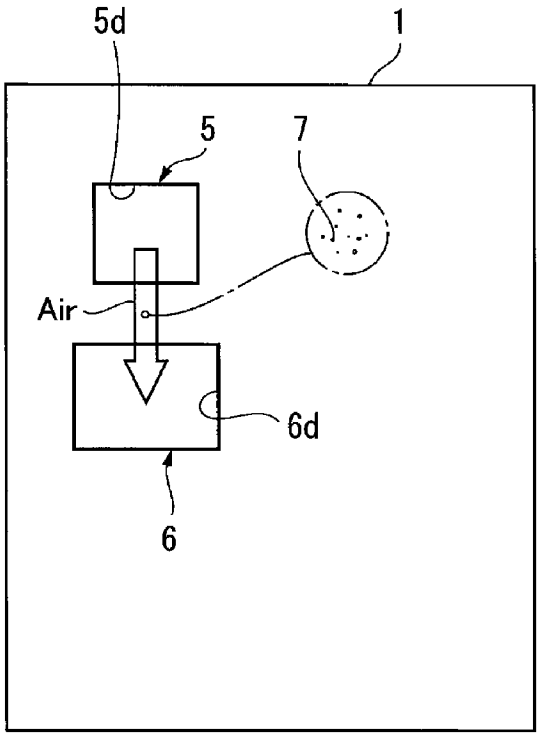
FIG. 1B shows the powder processing apparatus as viewed in direction IB in FIG. 1A.
Figure 1A:
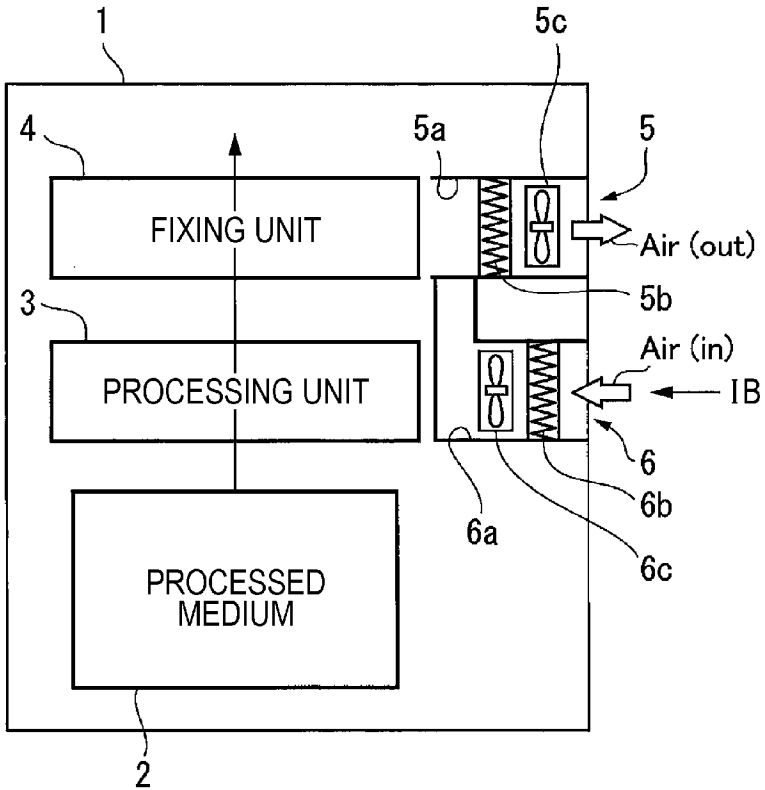
FIG. 1A shows the outline of an exemplary embodiment of a powder processing apparatus to which the present invention is applied.

FIG. 1A shows the outline of an exemplary embodiment of a powder processing apparatus to which the present invention is applied, and FIG. 1B shows the powder processing apparatus as viewed in direction IB in FIG. 1A.

The powder processing apparatus shown in FIGS. 1A and 1B includes: a fixing unit 4 that is provided in an apparatus housing 1 and that heats powder containing ultrafine particles (UFPs) 7 to fix the powder on a processed medium 2; an exhaust unit 5 including an exhaust path 5*a* through which the air in the vicinity of the fixing unit 4 can be discharged, a capturing part 5*b* capable of capturing the ultrafine particles 7, and an airflow generating part 5*c* that generates exhaust airflow, the capturing part 5*b* and the airflow generating part 5*c* being provided in part of the exhaust path 5*a*, the exhaust unit 5 discharging the air in the vicinity of the fixing unit 4 to the outside of the apparatus housing 1 through the exhaust path 5*a*; and an intake unit 6 including an intake path 6*a* through which the air outside the apparatus housing 1 can be taken in, a capturing part 6*b* capable of capturing the ultrafine particles 7, and an airflow generating part 6*c* that generates intake airflow, the capturing part 6*b* and the airflow generating part 6*c* being provided in part of the intake path 6*a*, the intake unit 6 taking the air outside the apparatus housing 1 into the apparatus housing 1 through the intake path 6*a*. An intake port 6*d* of the intake unit 6 is disposed below an exhaust port 5*d* of the exhaust unit 5 in the gravity direction.

In FIG. 1A, a processing unit 3 provided in the apparatus housing 1 processes the processed medium 2 using powder containing the ultrafine particles 7.

In this technical solution, the powder processing apparatuses widely include systems that process processed media 2 using powder containing ultrafine particles 7, and examples of the systems include image forming apparatuses, which form images on processed media 2 with toner, and powder coating apparatuses, which coat processed media 2 with powder. In this exemplary embodiment, although FIG. 1A shows a configuration including the processing unit 3, serving as the powder processing apparatus, separately from the fixing unit 4, a configuration in which only processing with the fixing unit 4 is performed, such as a configuration of a powder coating apparatus, is of course included in the present invention.

An example of the powder containing the ultrafine particles 7 is toner containing wax. Herein, the ultrafine particles 7 have diameters of 0.1 μm or less.

The exhaust (intake) paths 5*a* and 6*a*, the capturing parts (for example, filters) 5*b* and 6*b*, and the airflow generating parts (for example, fans) 5*c* and 6*c* need to be provided in the exhaust unit 5 and the intake unit 6, respectively.

However, the exhaust unit 5 and the intake unit 6 do not necessarily have to be provided in the apparatus housing 1, and ducts constituting the paths may extend to the outside of the apparatus housing 1.

The capturing parts 5*b* and 6*b* and the airflow generating parts 5*c* and 6*c* provided in the exhaust unit 5 and the intake unit 6 may have either the same or different capacities. Although the positional relationship between the capturing parts 5*b* and 6*b* and the airflow generating parts 5*c* and 6*c* may be freely chosen, it is desirable that the capturing parts 5*b* and 6*b* be provided upstream of the airflow generating parts 5*c* and 6*c* in the direction of airflow.

The intake unit 6 is configured to take the air outside the apparatus housing 1 into the apparatus housing 1 (Air (in)). Due to the positional relationship between the intake unit 6 and the exhaust unit 5, the air discharged from the exhaust unit 5 (Air (out)) is taken into the intake unit 6. The ultrafine particles 7 that have passed through the capturing part 5*b* of the exhaust unit 5 are contained in the air exhausted from the exhaust unit 5. When the ultrafine particles 7 are taken into the apparatus housing 1 through the intake unit 6, the ultrafine particles 7 taken into the apparatus housing 1 collide with one another more frequently and aggregate together. As a result, the aggregated ultrafine particles 7 are captured by the capturing part 6*b* of the intake unit 6 and the capturing part 5*b* of the exhaust unit 5 during recirculation.

The intake port 6*d* and the exhaust port 5*d* are openings facing the outside of the apparatus housing 1. A configuration in which the intake port 6*d* and the exhaust port 5*d* are provided in other surfaces of the apparatus housing 1 is also included in the present invention. For example, if the exhaust port 5*d* is provided in the back surface of the apparatus housing 1 facing a wall of a room, the exhaust moves toward an adjoining side surface. Hence, the intake port 6*d* may be provided in the side surface.

The intake port 6*d* is provided below the exhaust port 5*d* in the gravity direction. This is because the discharged ultrafine particles 7, which have weights, basically move downward due to the gravity, and, in offices and the like, where air-conditioning apparatuses are installed at high positions, airflow directed from top to bottom tends to be produced.

Next, an exemplary configuration of the powder processing apparatus according to this exemplary embodiment will be described.

First, in an exemplary layout, the exhaust port 5*d* and the intake port 6*d* are provided in the same surface of the apparatus housing 1.

In particular, in one configuration, the intake port 6*d* at least partially overlaps the exhaust port 5*d* in the horizontal direction, which is perpendicular to the gravity direction, or the intake port 6*d* is longer than the exhaust port 5*d* in the horizontal direction.

In one configuration, the quantity of air taken in by the intake unit 6 is larger than the quantity of air exhausted by the exhaust unit 5. In this exemplary embodiment, the air quantity Q ($m^3$/h) is defined by multiplication between the passage velocity v (m/s) and the passage area A ($m^2$). The passage area A is the sectional area of a path at a site where the passage velocity v is measured.

In this exemplary embodiment, in one configuration, the intake port 6*d* has a larger opening area than the exhaust port 5*d*. This is desirable because it is possible to set the intake air quantity large, even if the passage velocity v of the airflow in the exhaust unit 5 and that in the intake unit 6 are set to be equal.

In one configuration, the capturing part 6*b* has higher ultrafine-particle capturing capacity than the capturing part 5*b*. In this exemplary embodiment, the capturing capacity can be increased by increasing the number of filters layered, by reducing the size of through-holes in the filters, or the like.

In one configuration, the airflow generating parts 5*c* and 6*c* of the exhaust unit 5 and the intake unit 6 continue to operate for a predetermined period of time after the fixing unit 4 has completed the operation. Because the exhaust unit 5 and the intake unit 6 continue to operate for a predetermined period of time after the fixing unit 4 has completed the operation, the air exhausted from the exhaust unit 5 returns to the inside of the apparatus housing 1 through the intake unit 6, and the capturing parts 5*b* and 6*b* continue to capture the ultrafine particles 7. Consequently, the amount of the ultrafine particles 7 scattered outside the apparatus housing 1 is reduced.

In particular, in one configuration, the airflow generating part 6*c* stops after the airflow generating part 5*c* stops. In this exemplary embodiment, because the airflow generating part 6*c* operates for a predetermined period of time after the airflow generating part 5*c* stops, the air exhausted from the exhaust unit 5 is taken in through the intake unit 6, and the ultrafine particles 7 contained in the air taken in through the intake unit 6 are captured by the capturing part 6*b*. Thus, compared with a configuration in which the airflow generating parts 5*c* and 6*c* stop simultaneously, the duration of time in which the ultrafine particles 7 are captured increases, and thus, the amount of the ultrafine particles 7 scattered outside the apparatus housing 1 is further reduced.

In this exemplary embodiment, the exhaust unit 5 discharges the air in the vicinity of the fixing unit 4 to the outside of the apparatus housing 1 through the exhaust path 5*a*. Although the configurations of the intake unit 6 widely include those in which the air outside the apparatus housing 1 is taken into the apparatus housing 1, a structure in which the intake path 6*a* of the intake unit 6 communicates with the vicinity of the fixing unit 4 is desirable. In this exemplary embodiment, based on the fact that most of the ultrafine particles 7 are produced in the vicinity of the fixing unit 4, the air is taken in in the vicinity of the fixing unit 4, and discharge of the air toward the exhaust unit 5 is promoted. Hence, in this exemplary embodiment, when the ultrafine particles 7 that have been scattered outside the apparatus housing 1 are returned to the vicinity of the fixing unit 4 through the intake unit 6, the ultrafine particles 7 collide with ultrafine particles 7 that are newly produced in the vicinity of the fixing unit 4 and aggregate together and then are captured by the capturing part 5*b*. As a result, the amount of the ultrafine particles 7 scattered outside the apparatus housing 1 is further reduced. In this exemplary embodiment, as shown in FIG. 1A, although the intake path 6*a* branches off from the exhaust path 5*a* in the middle thereof, the exhaust path 5*a* and the intake path 6*a* may be independently formed. However, in the configuration in which the intake path 6*a* branches off from the exhaust path 5*a* in the middle thereof, the ultrafine particles 7 taken in through the intake unit 6 recirculate and are more effectively captured by the capturing part 5*b*.

The present invention will be described in detail below on the basis of the exemplary embodiments illustrated in the attached drawings.

First Exemplary Embodiment

Overall Configuration of Image Forming Apparatus

Figure 2A:
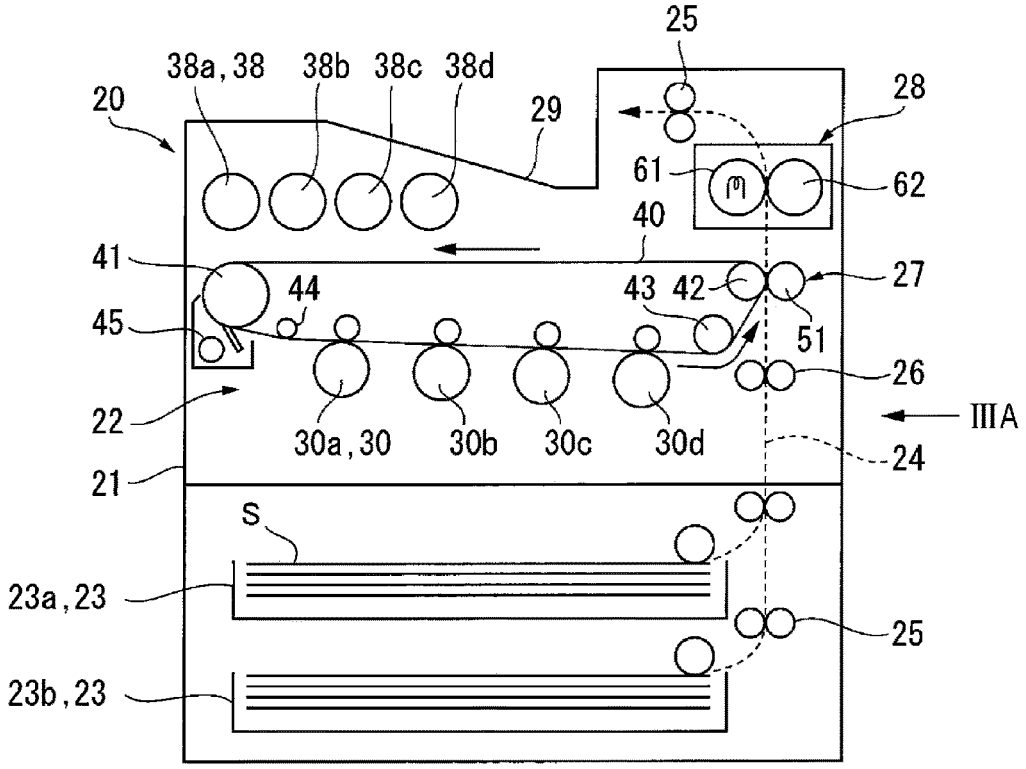
FIG. 2A shows the overall configuration of an image forming apparatus, serving as the powder processing apparatus according to exemplary embodiment 1.

FIG. 2A shows the overall configuration of an image forming apparatus, serving as the powder processing apparatus according to exemplary embodiment 1.

In FIG. 2A, an image forming apparatus 20 includes an apparatus housing 21, an image forming engine 22 provide din the apparatus housing 21, and sheet feed containers 23 (23*a* and 23*b* in this exemplary embodiment) provided below the image forming engine 22. A sheet S fed from one of the sheet feed containers 23 is transported along a sheet transport path 24 extending substantially vertically to a simultaneous transfer device 27, where images formed in the image forming engine 22 are simultaneously transferred to the sheet S. Then, the image is fixed on the sheet S by a fixing device 28 provided on the downstream side in the sheet transport direction, and the sheet S having the image fixed thereto is discharged onto an output-sheet receiving part 29 provided in the top of the apparatus housing 21.

An appropriate number of transport rollers 25 are provided along the sheet transport path 24. Registration rollers 26 provided on the sheet-entrance side of the simultaneous transfer device 27 adjust the timing of transporting the sheet S to the simultaneous transfer device 27.

Image Forming Engine

In this exemplary embodiment, the image forming engine 22 includes multiple image forming units 30 (more specifically, 30*a* to 30*d*) that form multiple color-component images (in this exemplary embodiment, yellow (Y), magenta (M), cyan (C), and black (K)). After the images formed in the respective image forming units 30 are first-transferred to an intermediate transfer body 40, the images on the intermediate transfer body 40 are simultaneously transferred (second-transferred) to the sheet S in the simultaneous transfer device 27.

Figure 2B:
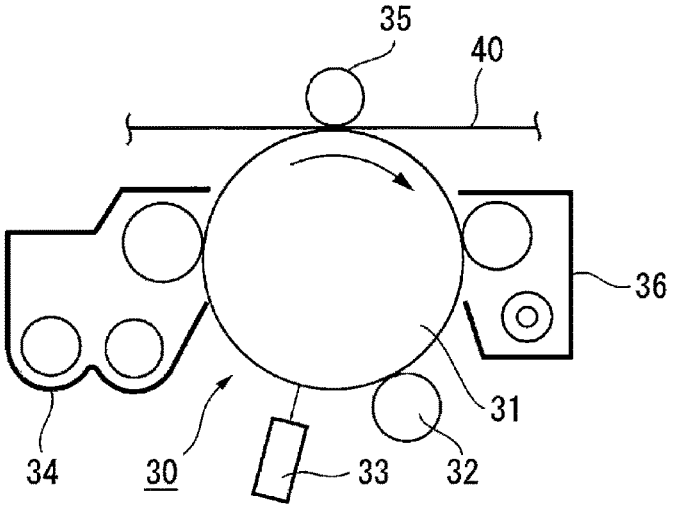
FIG. 2B shows an example of an image forming unit in FIG. 2A.

In this exemplary embodiment, the image forming units 30 (30*a* to 30*d*) use an electrophotographic system. As shown in, for example, FIG. 2B, the image forming units 30 each include a drum-shaped photoconductor 31, around which the following components are provided in this order: a charging device 32, which is formed of, for example, a charging roller, to charge the photoconductor 31; a latent image writing device 33, which is formed of, for example, an LED array, to form an electrostatic latent image on the charged photoconductor 31; a developing device 34 to develop the electrostatic latent image formed on the photoconductor 31 with a color component toner, serving as image forming particles; a first transfer device 35, which is formed of, for example, a transfer roller and is provided on the reverse side of the intermediate transfer body 40 facing the photoconductor 31, to first-transfer the image on the photoconductor 31 to the intermediate transfer body 40; and a cleaning device 36 to clean the toner remaining on the photoconductor 31 after the first transfer.

Toner cartridges 38 (more specifically, 38*a* to 38*d*) supply the color component toners to be used in the developing devices 34 of the image forming units 30.

In this exemplary embodiment, the intermediate transfer body 40 is a belt-shaped member stretched around multiple stretching rollers 41 to 44 and is driven by, for example, the stretching roller 41, serving as a driving roller, so as to revolve in a predetermined direction. The stretching roller 43 serves as a tension roller that applies tension to the intermediate transfer body 40. An intermediate-transfer-body cleaning device 45 removes residues (toner, paper dust, etc.) on the intermediate transfer body 40.

In this exemplary embodiment, the simultaneous transfer device 27 includes a transfer roller 51 that is in contact with the surface of the intermediate transfer body 40 so as to be rotatable in a driven manner. By forming a desired transfer electric field between the transfer roller 51 and the stretching roller 42 of the intermediate transfer body 40, serving as a counter electrode, the images held on the intermediate transfer body 40 are simultaneously transferred to the sheet S.

Fixing Device

In this exemplary embodiment, the fixing device 28 includes a heat-fixing roller 61, which is disposed so as to be in contact with the image holding surface of the sheet S and which can drivingly rotate, and a pressure fixing roller 62, which faces and is pressed against the heat-fixing roller 61 and is rotated by the heat-fixing roller 61. The fixing device 28 allows the sheet S to pass through a transfer area between the fixing rollers 61 and 62 to fix the image held on the sheet S by means of heat and pressure. The fixing method used by the fixing device 28 is not limited to one described in this exemplary embodiment, and any fixing method, such as a non-contacting method or a method using laser light, may be chosen.

Source of Ultrafine Particles

In this exemplary embodiment, color component toners are used as image forming particles. Many color component toners contain wax for increased releasability. When a sheet S having an image formed with toners containing wax passes through the fixing device 28, the heat from the heat-fixing roller 61 acts on the image, vaporizing the wax. When the vaporized wax cools, ultrafine particles UP, which have particle diameters of 1 μm or less, tend to be generated in the vicinity of the fixing device 28.

If such ultrafine particles UP are directly discharged outside the apparatus housing 21, the ultrafine particles UP are scattered outside the apparatus housing 21, deteriorating the indoor environment.

In this exemplary embodiment, because the heated air needs to be discharged outside the apparatus housing 21 even though the ultrafine particles UP are produced, and because cooling air needs to be taken into the apparatus housing 21 from outside the apparatus housing 21, an exhaust mechanism 100 and an intake mechanism 120 (see FIG. 3) are configured as below.

Exhaust Mechanism

Figure 3A:
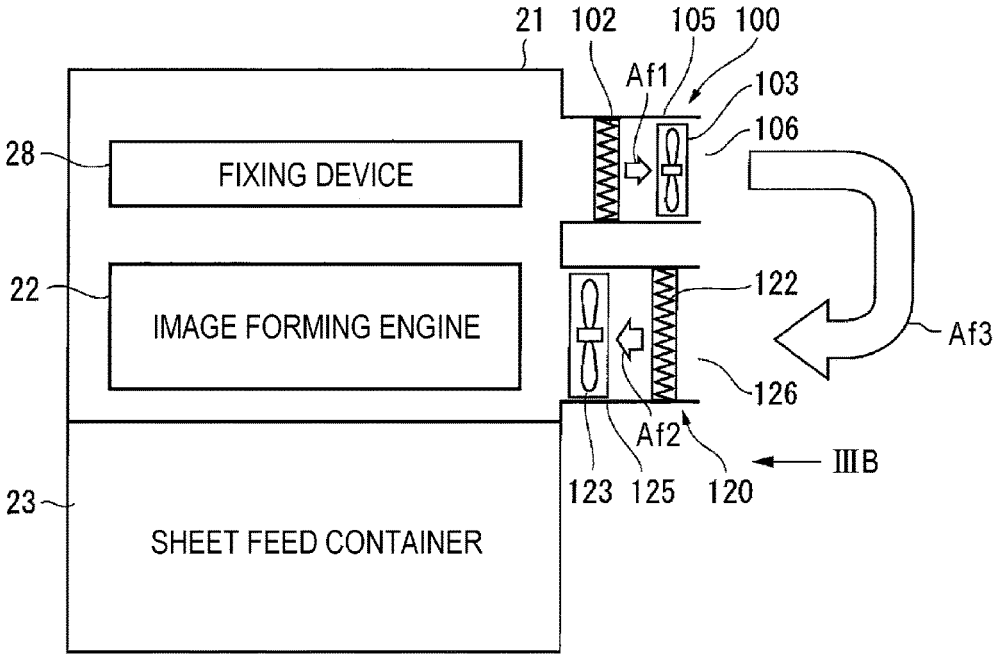
FIG. 3A is a diagram as viewed in direction IIIA in FIG. 2A.
Figure 3B:
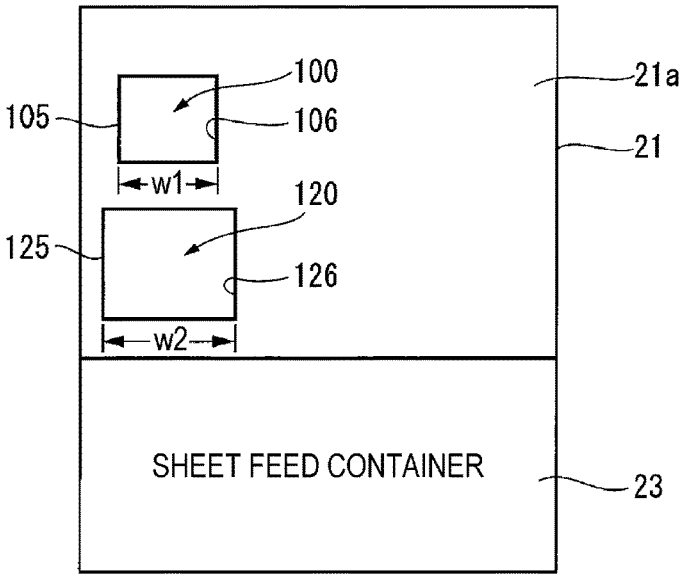
FIG. 3B is a diagram as viewed in direction IIIB in FIG. 3A.
Figure 4:
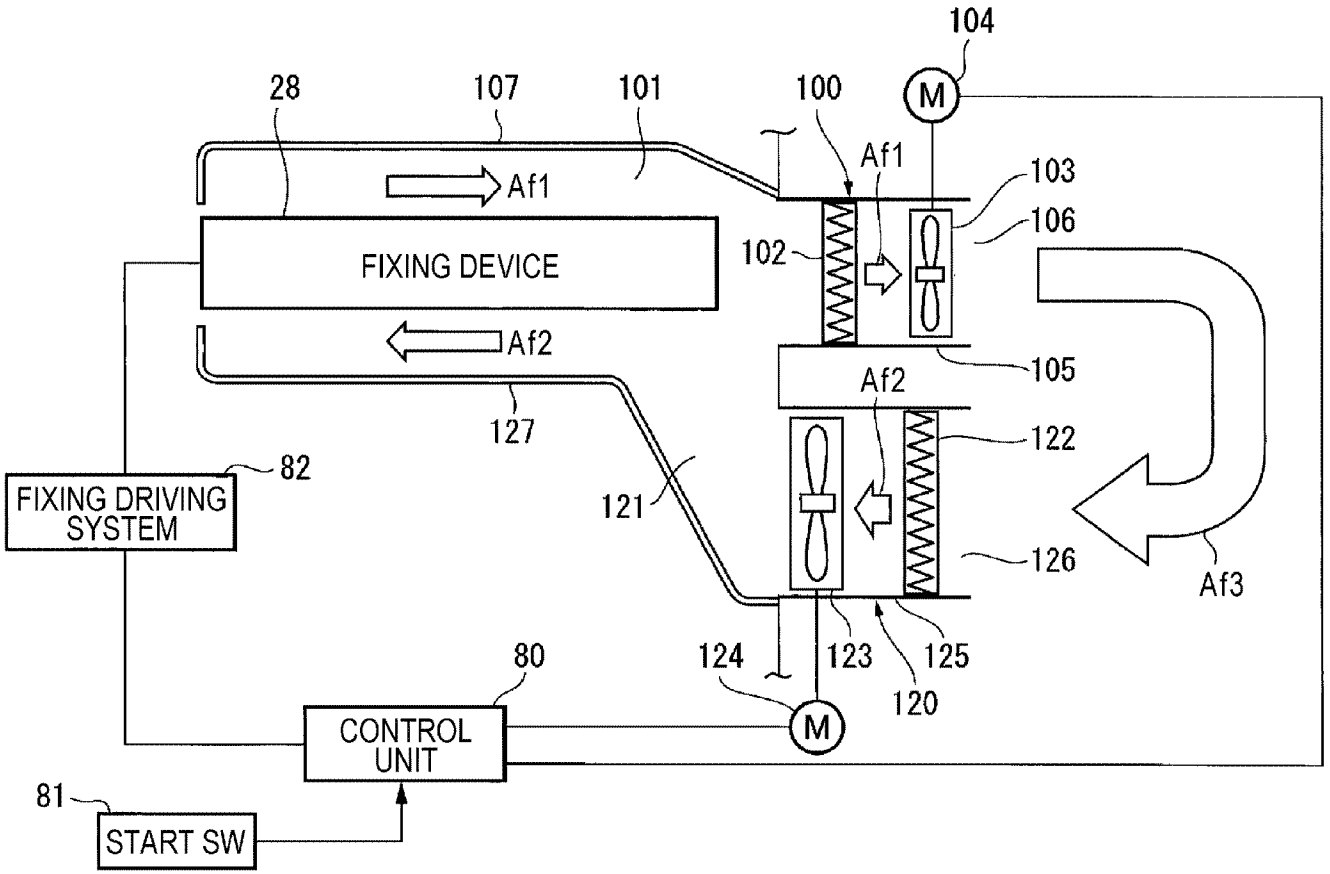
FIG. 4 shows the configuration of an exhaust mechanism, an intake mechanism, a fixing device and the vicinity thereof, and a driving control system according to exemplary embodiment 1.

In this exemplary embodiment, as shown in FIGS. 3A, 3B, and 4, the exhaust mechanism 100 includes an exhaust path 101 through which the air in the vicinity of the fixing device 28 can be discharged, an exhaust filter 102 capable of capturing ultrafine particles UP, and an exhaust fan 103 that generates exhaust airflow. The exhaust filter 102 and the exhaust fan 103 are provided in part of the exhaust path 101. The air in the vicinity of the fixing device 28 is discharged outside the apparatus housing 21 through the exhaust path 101.

In this exemplary embodiment, the exhaust path 101 leads to an exhaust duct 105 from the area above the vicinity of the fixing device 28. The exhaust duct 105 is open as an exhaust port 106 in the upper part of a back plate 21*a* of the apparatus housing 21. In the exhaust duct 105, the exhaust filter 102, which is changeable, is provided on the upstream side in the exhaust direction, and the exhaust fan 103 is provided downstream of the exhaust filter 102 in the exhaust direction.

The exhaust filter 102 has through-holes 102*a* (see FIG. 6) that can capture, for example, ultrafine particles UP having particle diameters larger than or equal to the average particle diameter. The exhaust filter 102 is changed when the amount of the ultrafine particles UP captured has exceeded an acceptable level. The exhaust fan 103 is driven by a driving motor 104.

In FIG. 4, a guide plate 107 guides the air heated in the fixing device 28 along the exhaust path 101 leading to the exhaust duct 105.

Intake Mechanism

In this exemplary embodiment, as shown in FIGS. 3A and 4, the intake mechanism 120 includes an intake path 121 through which the air outside the apparatus housing 21 can be taken in, an intake filter 122 capable of capturing ultrafine particles UP, and an intake fan 123 that generates intake airflow. The intake filter 122 and the intake fan 123 are provided in part of the intake path 121. The air outside the apparatus housing 21 is taken into the apparatus housing 21 through the intake path 121.

In this exemplary embodiment, the intake path 121 leads to an intake duct 125 from the area below the vicinity of the fixing device 28. The intake duct 125 is open as an intake port 126 in the back plate 21*a* of the apparatus housing 21, at a position below the exhaust port 106 of the exhaust duct 105. In the intake duct 125, the intake filter 122, which is changeable, is provided on the upstream side in the air-intake direction, and the intake fan 123 is provided downstream of the intake filter 122 in the air-intake direction.

The intake filter 122 has through-holes (not shown) that can capture, for example, ultrafine particles UP having particle diameters larger than or equal to the average particle diameter. The intake filter 122 is changed when the amount of the ultrafine particles UP captured has exceeded an acceptable level. The intake fan 123 is driven by a driving motor 124.

In FIG. 4, a guide plate 127 guides the air taken in through the intake duct 125 to the area below the fixing device 28, along the intake path 121 leading to the intake duct 125.

Layout of Exhaust Mechanism and Intake Mechanism

In this exemplary embodiment, as shown in FIG. 3B, the exhaust port 106 of the exhaust duct 105 in the exhaust mechanism 100 and the intake port 126 of the intake duct 125 in the intake mechanism 120, which both have rectangular shapes, are provided in the back plate 21*a*. The intake port 126 of the intake duct 125 and the exhaust port 106 of the exhaust duct 105 are arranged so as to partially overlap each other in the horizontal direction.

In this exemplary embodiment, as shown in FIG. 3B, when the horizontal length of the exhaust port 106 of the exhaust duct 105 is w1, and the horizontal length of the intake port 126 of the intake duct 125 is w2, the relationship w2>w1 is satisfied.

Exhaust Property and Intake Property

Figures 5A, 5B:
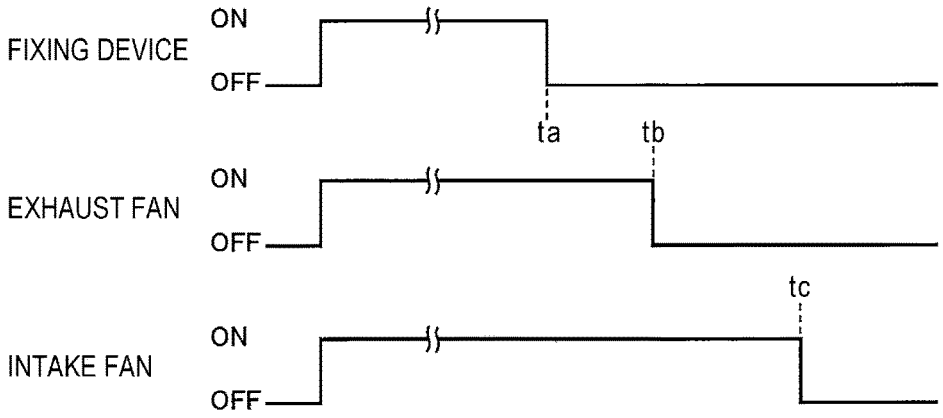
FIG. 5A shows the exhaust property and the intake property.
FIG. 5B shows an example of driving control of the exhaust mechanism and the intake mechanism.

In this exemplary embodiment, the exhaust mechanism 100 and the intake mechanism 120 have exhaust properties and intake properties as shown in FIG. 5A.

When the property parameter is the air quantities, and the exhaust air quantity is Q1, and the intake air quantity is Q2, although the air quantities Q1 and Q2 may be equal, it is desirable that the air quantities Q1 and Q2 be set as Q2>Q1, from the standpoint of further improving the ultrafine-particles collecting efficiency.

The air quantity Q ($m^3$/h) is defined by multiplication between the passage velocity v (m/s) and the passage area A ($m^2$). The passage area A is the sectional area of a path at a site where the passage velocity v is measured. The passage velocity v can be measured with an anemometer.

When the property parameter is the opening areas of the exhaust duct 105 and the intake duct 125, and the opening area of the exhaust port 106 of the exhaust duct 105 is A1 and the opening area of the intake port 126 of the intake duct 125 is A2, although the opening areas A1 and A2 may be equal, it is desirable that the opening areas A1 and A2 satisfy the relationship A2>A1, from the standpoint of further improving the ultrafine-particles collecting efficiency.

When the property parameter is the capturing capacities of the exhaust filter 102 and the intake filter 122, and the capturing capacity of the exhaust filter 102 is F1 and the capturing capacity of the intake filter 122 is F2, although the capturing capacities F1 and F2 may be equal, it is desirable that the capturing capacities F1 and F2 satisfy the relationship F2>F1, from the standpoint of further improving the ultrafine-particles collecting efficiency.

The capturing capacities F1 and F2 can be changed by changing the size of the through-holes that can capture the ultrafine particles UP and the number of filter members that can be layered. For example, the smaller the size of the through-holes is, the higher the capturing capacity is, and the larger the number of the filter members is, the higher the capturing capacity is.

Exhaust/Intake Control System

In this exemplary embodiment, as shown in FIG. 4, the exhaust/intake control system includes a control unit 80, which includes a microcomputer. When a start switch (start SW) 81 for starting a series of image forming processing is operated, the control unit 80 drives and controls a fixing driving system 82 of the fixing device 28 and drives and controls the driving motor 104 for the exhaust fan 103 in the exhaust mechanism 100 and the driving motor 124 for the intake fan 123 in the intake mechanism 120.

In particular, in this exemplary embodiment, as shown in FIG. 5B, the control unit 80 actuates (turns ON) the fixing device 28 when a series of image forming processing is started, and stops (turns OFF) the fixing device 28 when the series of image forming processing is completed. The control unit 80 stops the exhaust fan 103 at time tb, which is a predetermined period of time after time ta, at which the fixing device 28 is stopped, and stops the intake fan 123 at time tc, which is a predetermined period of time after time tb, at which the exhaust fan 103 is stopped.

Exhaust/Intake Processing

Next, exhaust/intake processing in the image forming apparatus according to this exemplary embodiment will be described.

Figure 6:
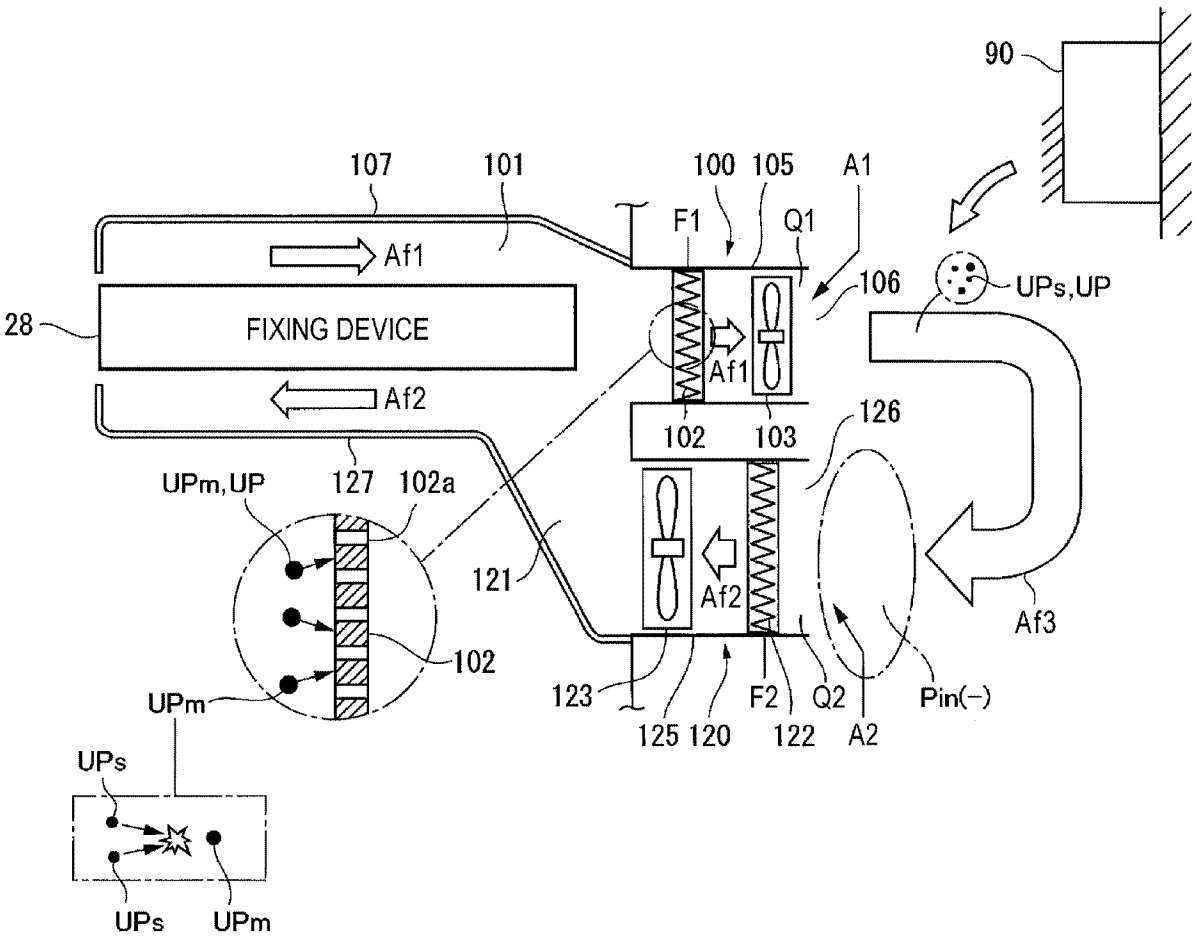
FIG. 6 shows the operation of the exhaust mechanism and the intake mechanism of the image forming apparatus according to exemplary embodiment 1.

As shown in FIG. 6, it is assumed that a series of image forming processing is being performed, and a transferred toner image is being fixed on a sheet by heat by the fixing device 28.

In this state, because the control unit 80 drives the exhaust fan 103 of the exhaust mechanism 100 and the intake fan 123 of the intake mechanism 120, exhaust airflow Af1 directed in the direction in which the air in the vicinity of the fixing device 28 is discharged is generated in the exhaust path 101 in the exhaust duct 105. Meanwhile, in the intake path 121 leading to the intake duct 125, intake airflow Af2 directed in the direction in which the air is sucked toward the vicinity of the fixing device 28 is generated.

At this time, a large number of ultrafine particles UP are produced in the vicinity of the fixing device 28, and the ultrafine particles UP tend to pass through the exhaust duct 105 with the exhaust airflow Af1. In this state, ultrafine particles UPm that are contained in the exhaust airflow Af1 and have diameters larger than or equal to the average particle diameter are captured by the exhaust filter 102, and a portion of the ultrafine particles UP, which is mostly ultrafine particles UPs that have diameters smaller than the average particle diameter, pass through the exhaust filter 102 and are scattered outside the apparatus housing 21.

In this state, the air discharged from the exhaust port 106 of the exhaust duct 105, which has been heated by the fixing device 28, is mixed with the air outside the apparatus housing 21 and is cooled.

As has been described above, although a portion of the ultrafine particles UP is scattered outside the apparatus housing 21, the scattered ultrafine particles UP fall in the gravity direction due to their own weight. Furthermore, because an air-conditioning apparatus (air-conditioner) 90 provided at a high position in an indoor space often blows air obliquely downward, the ultrafine particles UP scattered outside the apparatus housing 21 from the exhaust port 106 of the exhaust duct 105, which are mostly the ultrafine particles UPs having diameters less than the average particle diameter, move to an area outside the apparatus housing 21 and facing the intake port 126 with circulating airflow Af3 directed from the exhaust port 106 to the intake port 126 of the intake duct 125.

The ultrafine particles UP floating in front of the intake port 126 of the intake duct 125 are taken into the intake duct 125 with the intake airflow Af2 generated by the intake fan 123.

In particular, in this exemplary embodiment, assuming that the intake mechanism 120 has an intake property in which the air quantity Q2>the air quantity Q1, or in which the opening area A2 of the intake port 126>the opening area A1 of the exhaust port 106, the pressure in the vicinity of the intake port 126 of the intake mechanism 120 is negative (Pin(−)). Hence, the ultrafine particles UP scattered outside the apparatus housing 21 are taken in with the intake airflow Af2 and, in addition, are more strongly taken into the intake duct 125 from the intake port 126 of the intake duct 125 due to the presence of the negative pressure environment.

Although most of the ultrafine particles UP outside the apparatus housing 21 are the small-diameter ultrafine particles UPs, which have diameters smaller than the average particle diameter, the ultrafine particles UPs taken in through the intake duct 125 collide with each other and aggregate together in the intake duct 125, or the ultrafine particles UPs having reached the vicinity of the fixing device 28 collide with each other and aggregate together, forming ultrafine particles UPm, which have diameters larger than or equal to the average particle diameter. As a result, the ultrafine particles UPs returned into the apparatus housing 21 aggregate together, forming the ultrafine particles UPm, and are captured by the intake filter 122 in the intake duct 125 or the exhaust filter 102 in the exhaust duct 105.

As has been described above, the ultrafine particles UP scattered outside the apparatus housing 21 are returned into the apparatus housing 21 and are captured in stages by the intake filter 122 and the exhaust filter 102 in the intake processing performed by the intake mechanism 120 and the exhaust processing performed by the exhaust mechanism 100. Hence, the concentration of the ultrafine particles UP scattered outside the apparatus housing 21 gradually decreases as the exhaust processing and the intake processing are repeated.

Furthermore, in this exemplary embodiment, as shown in, for example, FIGS. 5A and 6, assuming that the capturing capacity F2 of the intake filter 122 in the intake mechanism 120 is set to be higher than the capturing capacity F1 of the exhaust filter 102 in the exhaust mechanism 100 (for example, at the capturing capacity F2, ultrafine particles UP having particle diameters smaller than the average particle diameter by 10% can be captured), when the ultrafine particles UP scattered outside the apparatus housing 21 are returned into the intake duct 125, a portion of the ultrafine particles UPs that have not been captured by the exhaust filter 102 are captured by the intake filter 122 as they are, without aggregating together due to collision. Hence, the ability to collect ultrafine particles UP scattered outside the apparatus housing 21 is higher than that in the case where the capturing capacities F1 and F2 are substantially equal.

Furthermore, in this exemplary embodiment, as shown in FIG. 5B, once a series of image forming processing is completed, the fixing device 28 is stopped (turned OFF). After the fixing device 28 is stopped, the exhaust processing by the exhaust mechanism 100 and the intake processing by the intake mechanism 120 are continued for a predetermined period of time (tb−ta).

Hence, in this exemplary embodiment, even if the fixing device 28 is stopped, ultrafine particles UP produced in the vicinity of the fixing device 28 are exhausted through the exhaust filter 102 with the exhaust airflow Af1, and the ultrafine particles UPm are captured by the exhaust filter 102, and ultrafine particles UPs are scattered outside the apparatus housing 21. The ultrafine particles UP scattered outside the apparatus housing 21, which are mostly the ultrafine particles UPs, move to the intake port 126 with the circulating airflow Af3, are taken in through the intake filter 122 with the intake airflow Af2, are returned to the vicinity of the fixing device 28, and then are exhausted again through the exhaust filter 102 with the exhaust airflow Af1. As a result of the exhaust processing and the intake processing being continuously performed in this manner, the ultrafine particles UP are gradually captured by the filters 102 and 122 during these processing. Hence, the ability to collect the ultrafine particles UP scattered outside the apparatus housing 21 is maintained at a high level.

In particular, in this exemplary embodiment, because the intake processing by the intake mechanism 120 is performed for a predetermined period of time (tc-tb) after the exhaust processing by the exhaust mechanism 100 is completed, the ultrafine particles UP scattered outside the apparatus housing 21 are returned into the apparatus housing 21, aggregate together through collision or the like, and are captured by the intake filter 122. Thus, in this exemplary embodiment, the ability to collect the ultrafine particles UP scattered outside the apparatus housing 21 is maintained at a high level, compared with a configuration in which the exhaust processing and the intake processing are simultaneously stopped.

Next, the performance of the image forming apparatus according to exemplary embodiment 1 is evaluated through comparison with other configurations.

Figure 7A:
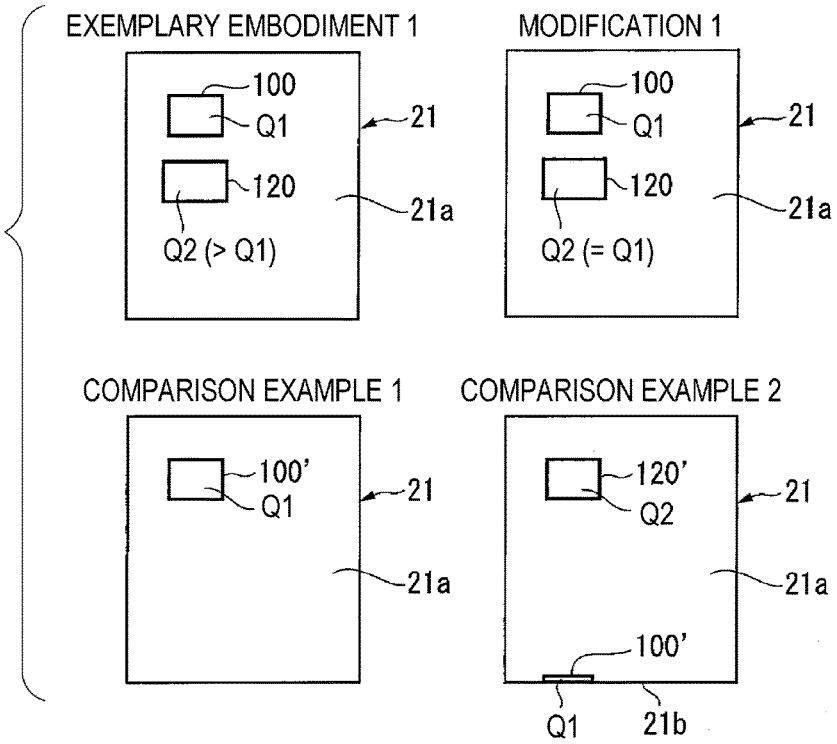
FIG. 7A schematically shows image forming apparatuses according to exemplary embodiment 1, modification 1, and comparison examples 1 and 2.

As shown in FIG. 7A, the exhaust processing by the exhaust mechanism 100 (100') and/or the intake processing by the intake mechanism 120 (120') are performed under the same conditions in the image forming apparatus according to exemplary embodiment 1, an image forming apparatus according to modification 1, in which exemplary embodiment 1 is partially changed, and image forming apparatuses according to comparison examples 1 and 2, and change in the concentration of the ultrafine particles scattered outside the apparatus housing 21 is observed.

In exemplary embodiment 1, the exhaust mechanism 100 and the intake mechanism 120 are open in the back plate 21*a* of the apparatus housing 21, and the relationship between the exhaust air quantity Q1 and the intake air quantity Q2 is Q2>Q1. Modification 1 basically has the same configuration as exemplary embodiment 1, except that the relationship between the exhaust air quantity Q1 and the intake air quantity Q2 is Q1=Q2. In comparison example 1, only an exhaust mechanism 100' having an exhaust air quantity Q1 is provided. In comparison example 2, an exhaust mechanism 100' that is open in a bottom surface plate 21*b* of the apparatus housing 21 and an intake mechanism 120' that is open in the upper part of the back plate 21*a* of the apparatus housing 21 are provided.

Figure 7B:
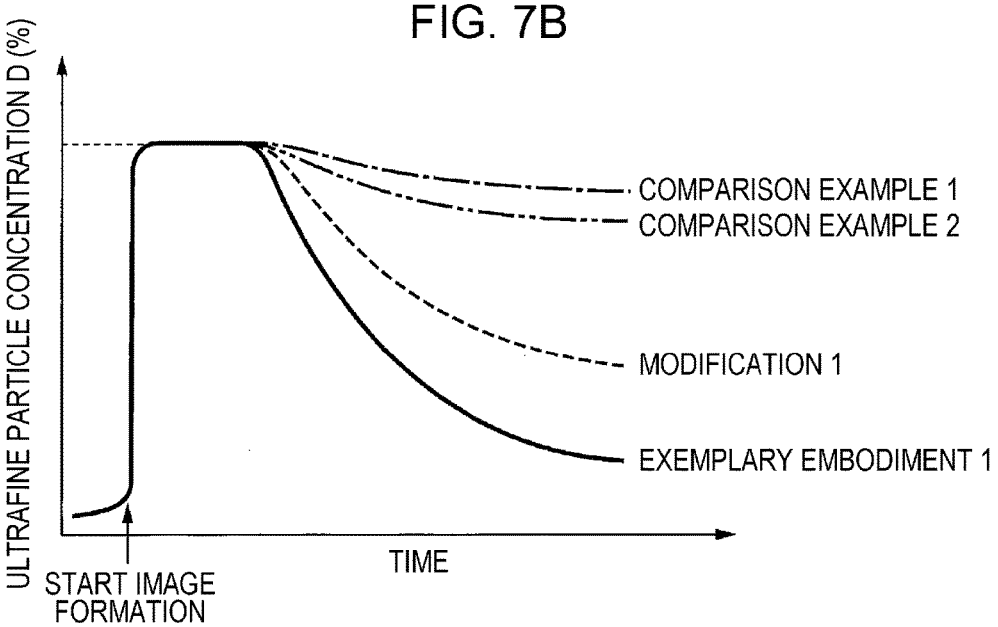
FIG. 7B shows the tendencies of the ultrafine-particle-collecting properties of the image forming apparatuses according to exemplary embodiment 1, modification 1, and comparison examples 1 and 2.

FIG. 7B shows the evaluation results.

First, it is understood that, in comparison examples 1 and 2, the concentration D (%) of the ultrafine particles scattered outside the apparatus housing 21 hardly decreases with time. However, in comparison example 2, the effect of reducing the concentration D of the ultrafine particles scattered outside the apparatus housing 21 is slightly better than in comparison example 1.

It is understood that, in exemplary embodiment 1 and modification 1, the concentration D (%) of the ultrafine particles scattered outside the apparatus housing 21 drastically decreases with time, compared with comparison examples 1 and 2. In particular, exemplary embodiment 1 has greater effect of reducing the ultrafine particle concentration D than modification 1, and it is understood that the configuration of exemplary embodiment 1 is effective.

Exemplary Embodiment 2

Figure 8A:
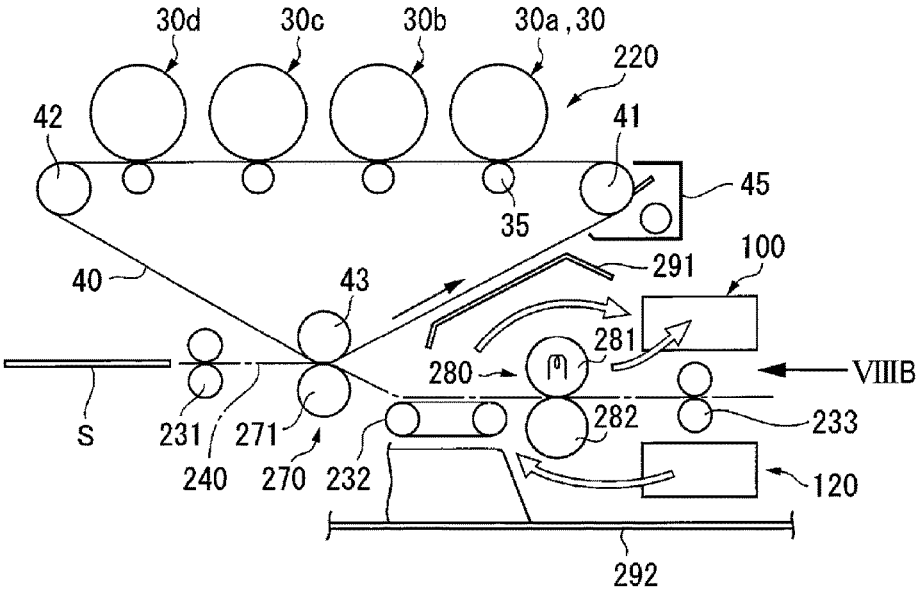
FIG. 8A shows the relevant part of an image forming apparatus according to exemplary embodiment 2.
Figure 8B:
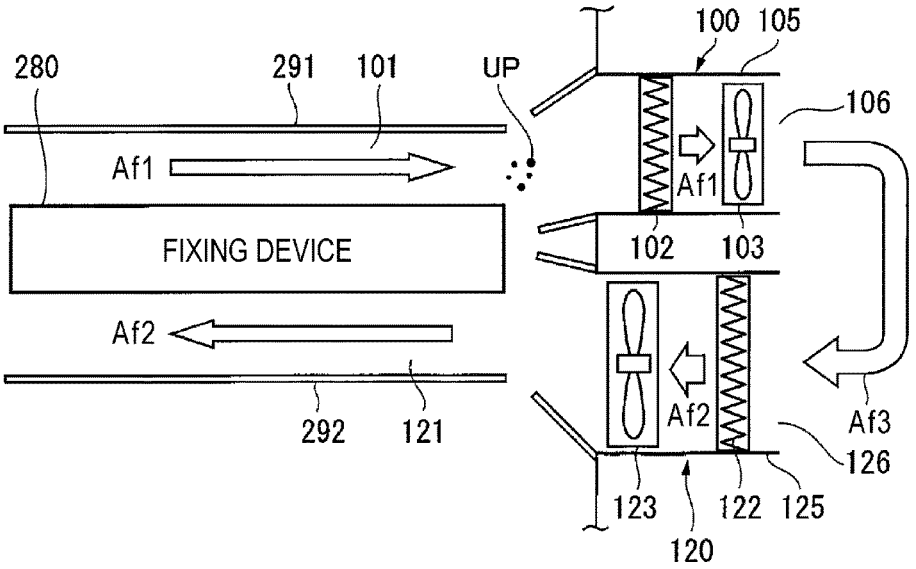
FIG. 8B shows the configuration of an exhaust mechanism, an intake mechanism, and a fixing device and the vicinity thereof as viewed in direction VIIIB in FIG. 8A.

FIG. 8A shows the relevant part of an image forming apparatus according to exemplary embodiment 2, and FIG. 8B is a diagram as viewed in direction B in FIG. 8A. The same components as those in exemplary embodiment 1 are denoted by the same reference signs, and detailed descriptions thereof will be omitted.

In FIGS. 8A and 8B, unlike exemplary embodiment 1, the image forming apparatus 20 includes an intermediate-transfer-type image forming engine 220, a sheet transport path 240 provided below the image forming engine 220 so as to extend substantially in the horizontal direction, a simultaneous transfer device 270 provided in the middle of the sheet transport path 240 to simultaneously transfer images formed in the image forming engine 220 to a sheet S, and a fixing device 280 that fixes images by means of heat and pressure and is provided downstream of the simultaneous transfer device 270 in the sheet transport direction.

In this exemplary embodiment, the image forming engine 220 includes multiple image forming units 30 (more specifically, 30*a* to 30*d*), which use an electrophotographic system, arranged in the substantially horizontal direction, and the intermediate transfer body 40 disposed at positions facing the respective image forming units 30 so as to be stretched around multiple stretching rollers 41 to 43.

The simultaneous transfer device 270 includes a transfer roller 271 facing the stretching roller 43, around which the intermediate transfer body 40 is stretched. A transfer electric field is formed between the transfer roller 271 and the stretching roller 43, which serves as a counter electrode.

The fixing device 280 includes a heat-fixing roller 281, which is drivingly rotatable and is disposed so as to be in contact with the image holding surface of a sheet S, and a pressure fixing roller 282, which faces and is pressed against the heat-fixing roller 281 and is rotated by the heat-fixing roller 281.

FIG. 8A shows the first transfer devices 35 that first-transfer images composed of respective color component toners and formed in the image forming units 30 to the intermediate transfer body 40, the intermediate-transfer-body cleaning device 45 for cleaning the intermediate transfer body 40, registration rollers 231 provided on the sheet-entrance side of the simultaneous transfer device 270 to adjust the timing of transporting the sheet S to the simultaneous transfer device 270, a transport belt 232 provided in the sheet transport path 240 between the simultaneous transfer device 270 and the fixing device 280 to transport the sheet S by being in contact with the non-image holding surface of the sheet S, and a transport roller 233.

Exhaust Mechanism and Intake Mechanism

In this exemplary embodiment, a heat-shielding plate 291 is provided between the fixing device 280 and the intermediate transfer body 40 to prevent the air heated by the fixing device 280 from moving toward the intermediate transfer body 40, and a partition plate 292 is provided below the image forming engine 220 and the fixing device 280 to partition them from a sheet feed container (not shown).

In this exemplary embodiment, the exhaust mechanism 100, which is open in the back plate 21*a* of the apparatus housing 21, is provided above the sheet transport path 240, on the downstream side of the fixing device 280 in the sheet transport direction, and the intake mechanism 120, which is open in the back plate 21*a* of the apparatus housing 21, is provided below the sheet transport path 240, on the downstream side of the fixing device 280 in the sheet transport direction.

The basic configuration of the exhaust mechanism 100 is substantially the same as that in exemplary embodiment 1, wherein the exhaust path 101 through which the air in the vicinity of the area above the fixing device 280 can be exhausted leads to the exhaust duct 105 from the vicinity of the area above the fixing device 280 partitioned by the heat-shielding plate 291, the exhaust filter 102 capable of capturing the ultrafine particles UP and the exhaust fan 103 that generates exhaust airflow are provided in the exhaust duct 105, and the outlet opening of the exhaust duct 105 serves as the exhaust port 106.

The basic configuration of the intake mechanism 120 is substantially the same as that in exemplary embodiment 1, wherein the intake path 121 through which the air outside the apparatus housing 21 can be taken in leads to the intake duct 125 from the vicinity of the area below the fixing device 280 partitioned by the partition plate 292, the intake filter 122 capable of capturing the ultrafine particles UP and the intake fan 123 that generates intake airflow are provided in the intake duct 125, and the inlet opening of the intake duct 125 serves as the intake port 126.

The layout of the exhaust port 106 of the exhaust duct 105 and the intake port 126 of the intake duct 125, the exhaust property of the exhaust mechanism 100, and the intake property of the intake mechanism 120 are set to be substantially the same as those in exemplary embodiment 1.

In the image forming apparatus according to this exemplary embodiment, similarly to exemplary embodiment 1, even if ultrafine particles UP are produced in the vicinity of the fixing device 280, the exhaust processing by the exhaust mechanism 100 and the intake processing by the intake mechanism 120 are repeatedly performed. Hence, similarly to exemplary embodiment 1, the concentration of the ultrafine particles UP scattered outside the apparatus housing 21 gradually decreases with time.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder processing apparatus comprising:

a fixing unit that is provided in an apparatus housing and heats powder containing ultrafine particles to fix the powder on a processed medium;

an exhaust unit comprising an exhaust path, a first capturing part and a first airflow generating part, wherein, air in the vicinity of the fixing unit can be exhausted through the exhaust path, the first capturing part comprises a first filter capable of capturing the ultrafine particles, and the first airflow generating part comprises a first fan that generates exhaust airflow, the first capturing part and the first airflow generating part being provided in part of the exhaust path, the exhaust unit exhausting the air in the vicinity of the fixing unit to the outside of the apparatus housing through the exhaust path; and an intake unit comprising an intake path, a second capturing part and a second airflow generating part, wherein, air outside the apparatus housing can be taken in through the intake path, the second capturing part comprises a second filter capable of capturing the ultrafine particles, and the second airflow generating part comprises a second fan that generates intake airflow, the second capturing part and the second airflow generating part being provided in part of the intake path, the intake unit taking the air outside the apparatus housing into the apparatus housing through the intake path, wherein an intake port of the intake unit is provided below an exhaust port of the exhaust unit in a gravity direction and the intake port is closer to a ground than the exhaust port.

2. The powder processing apparatus according to claim 1, wherein the intake port of the intake unit and the exhaust port of the exhaust unit are provided in the same surface of the apparatus housing.

3. The powder processing apparatus according to claim 2, wherein the intake port of the intake unit and the exhaust port of the exhaust unit are arranged so as to at least partially overlap each other in a horizontal direction perpendicular to the gravity direction.

4. The powder processing apparatus according to claim 2, wherein a length of the intake port of the intake unit is larger than a length of the exhaust port of the exhaust unit in a horizontal direction perpendicular to the gravity direction.

5. The powder processing apparatus according to claim 3, wherein a length of the intake port of the intake unit is larger than a length of the exhaust port of the exhaust unit in the horizontal direction.

6. The powder processing apparatus according to claim 1, wherein a quantity of air taken in by the intake unit is larger than a quantity of air exhausted by the exhaust unit.

7. The powder processing apparatus according to claim 6, wherein an opening area of the intake port of the intake unit is larger than an opening area of the exhaust port of the exhaust unit.

8. The powder processing apparatus according to claim 1, wherein ultrafine-particle capturing capacity of the second capturing part of the intake unit is higher than ultrafine-particle capturing capacity of the first capturing part of the exhaust unit.

9. The powder processing apparatus according to claim 1, wherein the first airflow generating part of the exhaust unit and the second airflow generating part of the intake unit continue to operate for a predetermined period of time after operation of the fixing unit is completed.

10. The powder processing apparatus according to claim 9, wherein the second airflow generating part of the intake unit is stopped after the first airflow generating part of the exhaust unit is stopped.

11. The powder processing apparatus according to claim 1, wherein the intake unit is configured such that the intake path leads to the vicinity of the fixing unit.

12. A powder processing apparatus comprising:

fixing means provided in an apparatus housing, the fixing means heating powder containing ultrafine particles to fix the powder on a processed medium;

exhaust means including an exhaust path through which air in the vicinity of the fixing means can be exhausted, first capturing means capable of capturing the ultrafine particles, and first airflow generating means for generating exhaust airflow, the first capturing means and the first airflow generating means being provided in part of the exhaust path, the exhaust means exhausting the air in the vicinity of the fixing means to the outside of the apparatus housing through the exhaust path; and intake means having an intake path through which air outside the apparatus housing can be taken in, second capturing means capable of capturing the ultrafine particles, and second airflow generating means for generating intake airflow, the second capturing means and the second airflow generating means being provided in part of the intake path, the intake means taking the air outside the apparatus housing into the apparatus housing through the intake path, wherein an intake port of the intake means is provided below an exhaust port of the exhaust means in a gravity direction and the intake port is closer to a ground than the exhaust port.

* * * * *